US011252494B2

(12) United States Patent
Mori

(10) Patent No.: US 11,252,494 B2
(45) Date of Patent: Feb. 15, 2022

(54) EARPHONE, COVER FOR DRIVER OF EARPHONE, AND COVER SET

(71) Applicant: YAMAHA CORPORATION, Hamamatsu (JP)

(72) Inventor: Tomoaki Mori, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 17/086,703

(22) Filed: Nov. 2, 2020

(65) Prior Publication Data

US 2021/0144460 A1 May 13, 2021

(30) Foreign Application Priority Data

Nov. 8, 2019 (JP) ..... JP2019-203143

(51) Int. Cl.
*H04R 1/10* (2006.01)

(52) U.S. Cl.
CPC ..... *H04R 1/1016* (2013.01); *H04R 1/1025* (2013.01)

(58) Field of Classification Search
CPC ..... H04R 1/1016; H04R 1/1025
USPC ..... 381/380
See application file for complete search history.

(56) References Cited

U.S. PATENT DOCUMENTS

| | | | | |
|---|---|---|---|---|
| 7,965,855 | B1 * | 6/2011 | Ham | H04R 1/1091 381/380 |
| 8,189,845 | B2 * | 5/2012 | Mulvey | H04R 1/1016 381/380 |
| 10,820,085 | B1 * | 10/2020 | Sandanger | H04R 1/1016 |
| 2009/0285436 | A1 * | 11/2009 | Lowry | H04R 1/1016 381/380 |
| 2011/0123059 | A1 * | 5/2011 | Hu | H04R 1/1016 381/380 |
| 2016/0173971 | A1 * | 6/2016 | Lott | H04R 25/659 381/380 |
| 2018/0176674 | A1 * | 6/2018 | Tang | H04R 1/1016 |
| 2019/0200112 | A1 * | 6/2019 | Briggs | H04R 1/1066 |

FOREIGN PATENT DOCUMENTS

JP 2015076856 A 4/2015

* cited by examiner

*Primary Examiner* — Sean H Nguyen
(74) *Attorney, Agent, or Firm* — Rossi, Kimms & McDowell LLP

(57) ABSTRACT

An earphone includes a driver body, an insertion portion extending from the driver body and configured to be inserted in an ear canal, a cover body covering the driver body and including, a first opening at a position corresponding to the insertion portion, and a projection configured to come into contact with a concha. The driver body is configured to attach and detach any of a plurality of types of cover bodies each including the projection with a height thereof projecting from the cover body, the heights of the projections of the plurality of types of cover bodies being different and increasing as a distance from the opening to the respective projection is increased.

15 Claims, 13 Drawing Sheets

EARPHONE, COVER FOR DRIVER OF EARPHONE, AND COVER SET

CROSS REFERENCE TO RELATED APPLICATIONS

This Nonprovisional application claims priority under 35 U.S.C. § 119(a) on Patent Application No. 2019-203143 filed in Japan on Nov. 8, 2019 the entire contents of which are hereby incorporated by reference.

BACKGROUND

Technical Field

An embodiment of the present disclosure relates to an earphone used by being inserted into an ear canal of a user.

Background Information

Japanese Unexamined Patent Application Publication No. 2015-076856 discloses an earphone that improves adhesion and is difficult to fall out of an ear. The earphone disclosed in Japanese Unexamined Patent Application Publication No. 2015-076856 includes a housing and a holder attached to the housing. The holder includes a ring surrounding a portion of the housing, and a convex portion protruding in a radial direction of the ring. The user places the convex portion between a concha and an antitragus so as to improve the adhesion.

However, a highly adhesive earphone for a user with an average-sized ear does not suit a user with a large ear or a user with a small ear. For example, it is difficult for the user with a large ear to bring the convex portion into contact with the concha. In contrast, it is difficult for the user with a small ear to fit the earphone into the ear because the convex portion is an obstacle.

In particular, the shapes of a concha vary depending on the size of an ear. Accordingly, a plurality of holders with different sizes of convex portions according to the size of an ear, even when being prepared, are not well usable due to the differences in the shapes of a concha. For example, the convex portion may not come into contact with a concha, or the convex portion may prevent the earphone from being fitted into an ear, in some cases.

SUMMARY

In view of the foregoing, an embodiment of the present disclosure is directed to provide an earphone that achieves proper adhesion according to the size of an ear.

An earphone includes a driver body, an insertion portion extending from the driver body and configured to be inserted in an ear canal, a cover body covering the driver body and including, a first opening at a position corresponding to the insertion portion, and a projection configured to come into contact with a concha.

The driver body is configured to attach and detach any of a plurality of types of cover bodies each including the projection with a height thereof projecting from the cover body, the heights of the projections of the plurality of types of cover bodies being different and increasing as a distance from the opening to the respective projection is increased.

According to an embodiment of the present disclosure, proper adhesion according to the size of an ear is able to be achieved.

DETAILED DESCRIPTION

Figure 1:
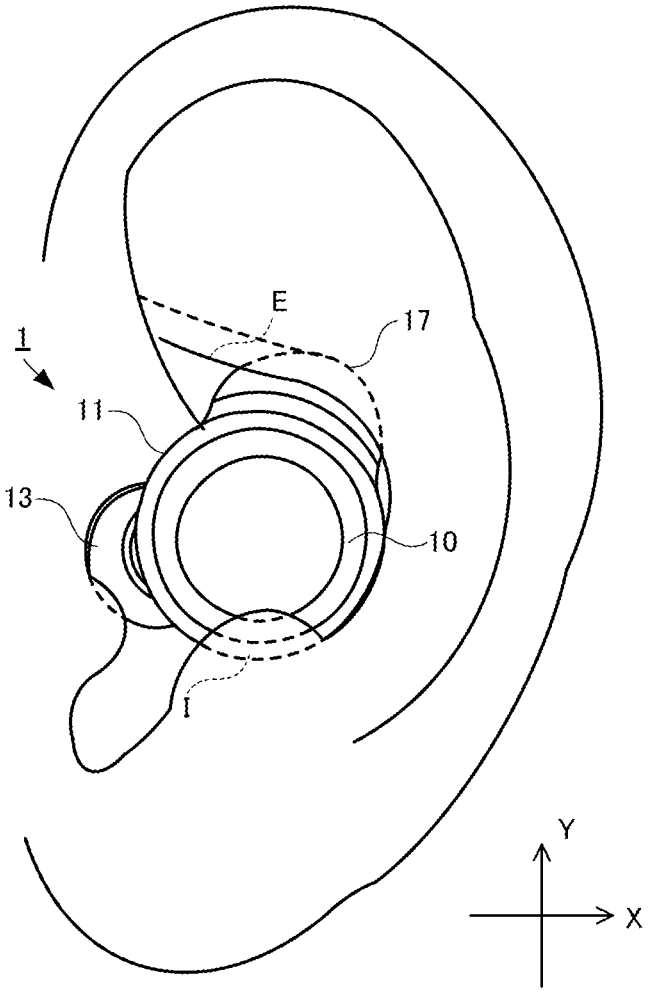
FIG. 1 is a diagram showing a state in which an earphone is worn in an ear.
Figure 2A:
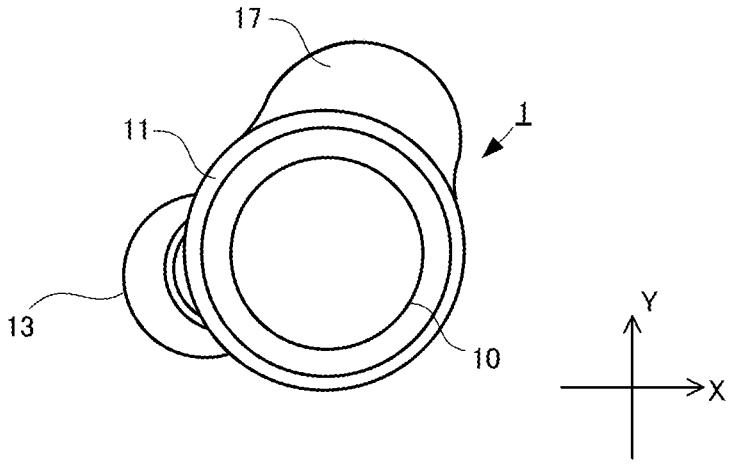
FIG. 2A is a front view of the earphone 1.
Figure 2B:
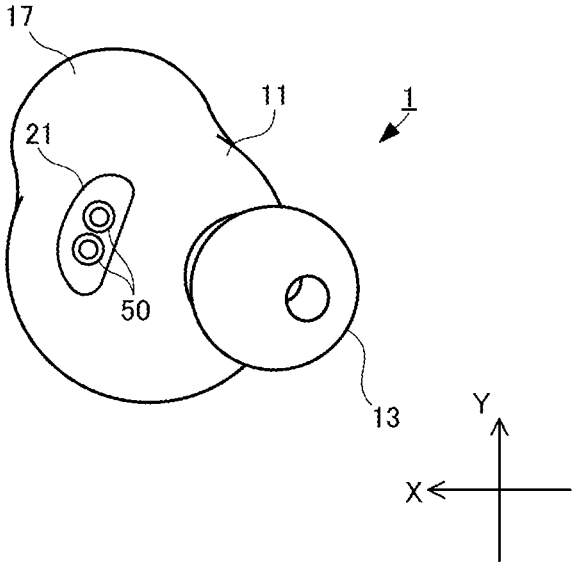
FIG. 2B is a rear view of the earphone 1.
Figure 3A:
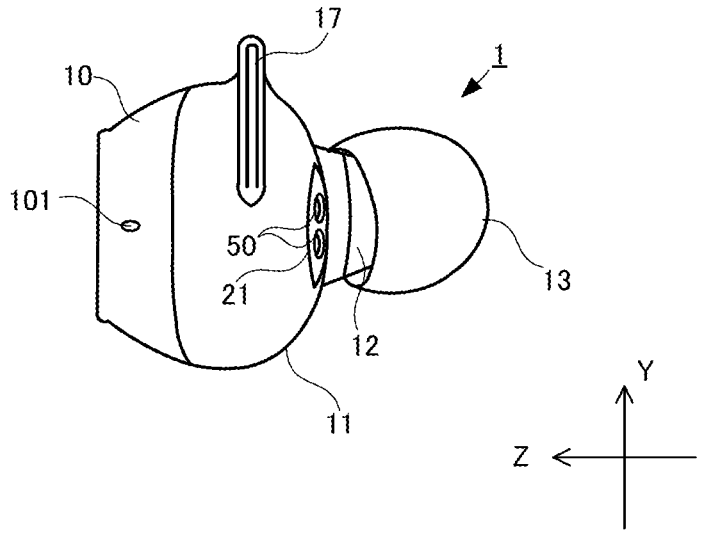
FIG. 3A is a right side view of the earphone 1.
Figure 3B:
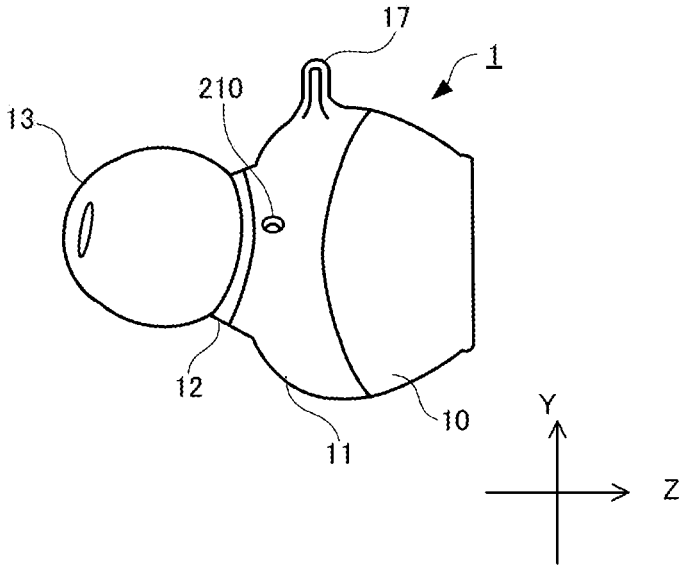
FIG. 3B is a left side view of the earphone 1.
Figure 4A:
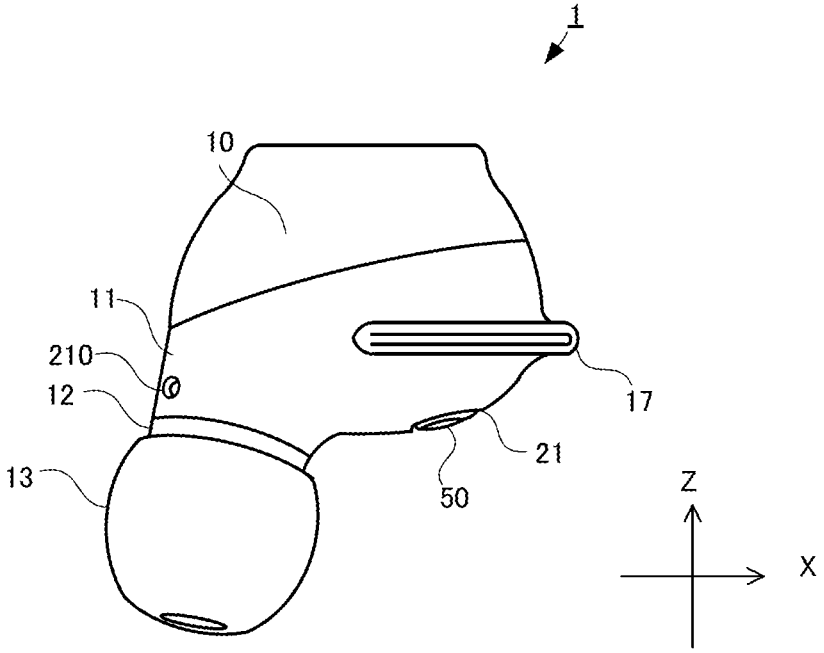
FIG. 4A is a top view of the earphone 1.
Figure 4B:
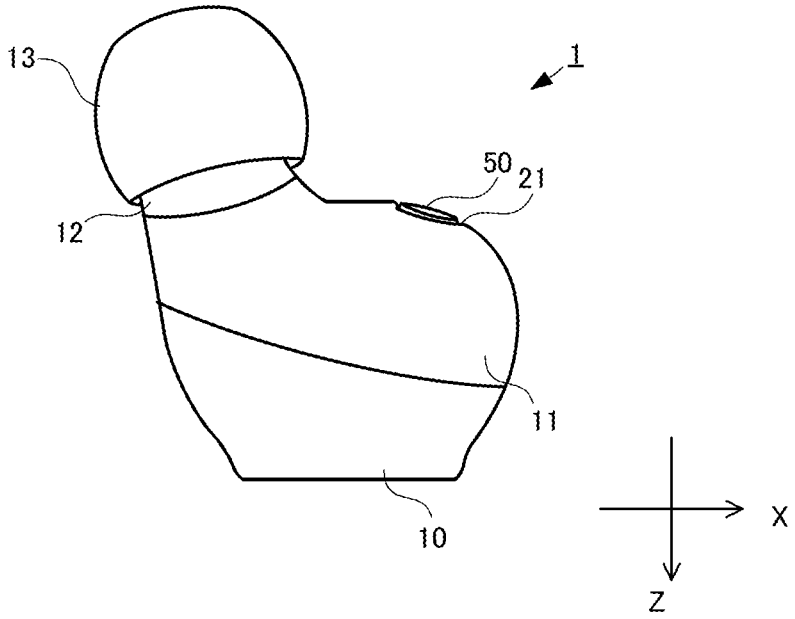
FIG. 4B is a bottom view of the earphone 1.

FIG. 1 is a diagram showing a state in which an earphone (an in-ear headphone) 1 is worn in an ear. FIG. 2A is a front view of the earphone 1. FIG. 2B is a rear view of the earphone 1. FIG. 3A is a right side view of the earphone 1. FIG. 3B is a left side view of the earphone 1. FIG. 4A is a top view of the earphone 1. FIG. 4B is a bottom view of the earphone 1. In the drawings, a right side direction, a top direction, and a front direction are respectively referred to as an X direction, a Y direction, and a Z direction.

The earphone 1 receives an audio signal through wireless communication such as Bluetooth (registered trademark), from an information processing terminal such as a smartphone, or a player such as a portable music reproduction apparatus. However, the present disclosure is not limited to an earphone for wireless communication. The earphone may be connected to the player with a cable.

The earphone 1 includes two units of a unit used by being inserted into a left ear and a unit used by being inserted into a right ear. The right and left units are not connected with a cable or the like. In other words, the earphone 1 is a true wireless earphone including right and left independent units. However, the present disclosure does not need to be right and left independent units. The right and left independent units may be connected with a cable.

Although the present embodiment describes a unit used by being inserted into a left ear, a unit used by being inserted into a right ear also has the same configuration and function.

The earphone 1 includes a driver body 10, a cover 11, and an insertion portion 12. The earphone 1 is used by being inserted into an ear canal. The driver body 10 internally stores a driver unit, a battery, a microphone, and similar components. The driver body 10 is a substantially cylindrical housing. However, the driver body of the present disclosure is not limited to a cylindrical shape. The driver body 10 includes an opening 101 for a microphone on the front side of the right side surface of the housing. A charging terminal 50 to charge a battery is provided on the rear side of the driver body 10.

The front side of the driver body 10 has a plane surface. The diameter of the driver body 10 gradually increases from the front side to the center of the rear side. The driver body 10 has the largest diameter in the center. The diameter of the driver body 10 gradually decreases from the center to the rear side. The rear side of the driver body 10 has a curved surface. The insertion portion 12 is provided on the rear side of the driver body 10.

The insertion portion 12 is obliquely projected from the rear side of the driver body 10 toward the left side. The insertion portion 12 is inserted into an ear canal of a user. The insertion portion 12 is covered by an earpiece 13. The earpiece 13 may be made of a resin with high flexibility, such as silicone rubber, polyurethane, or epoxy, for example. The earpiece 13 may be integrated with the insertion portion 12 or may be attachable to and detachable from the insertion portion 12. In a case in which the earpiece 13 is attachable to and detachable from the insertion portion 12, a plurality of types of earpieces of different sizes may be prepared. In such a case, the user can select an earpiece of a suitable size according to the size of the ear.

Figure 5A:
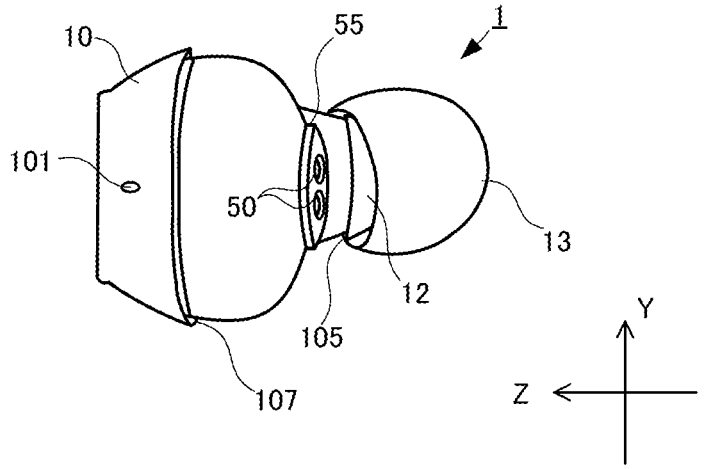
FIG. 5A is a right side view of the earphone 1 from which a cover 11 is detached.
Figure 5B:
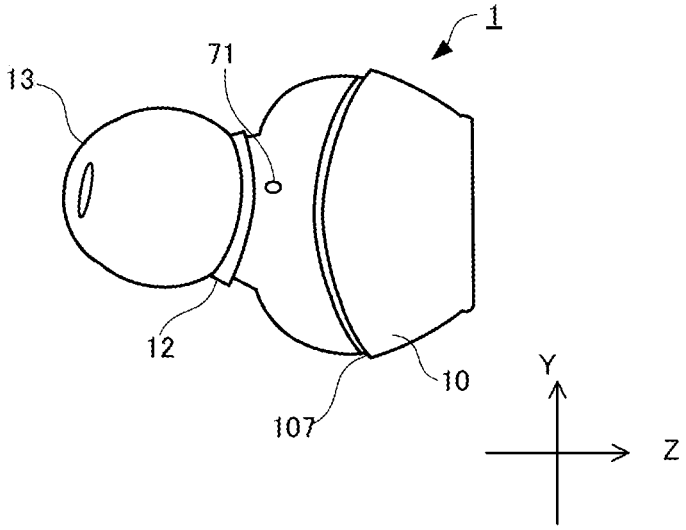
FIG. 5B is a left side view of the earphone 1 from which the cover 11 is detached.
Figure 6A:
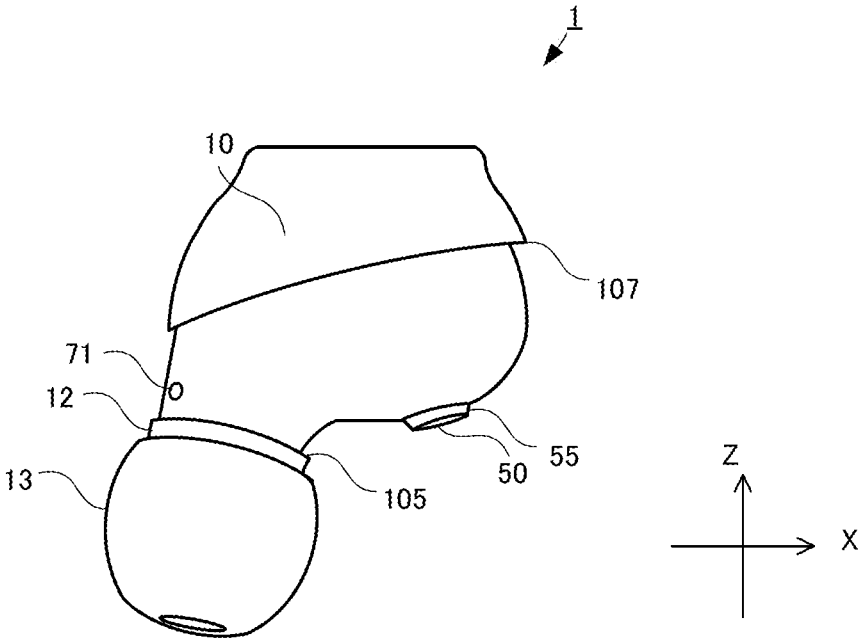
FIG. 6A is a top view of the earphone 1 from which the cover 11 is detached.
Figure 6B:
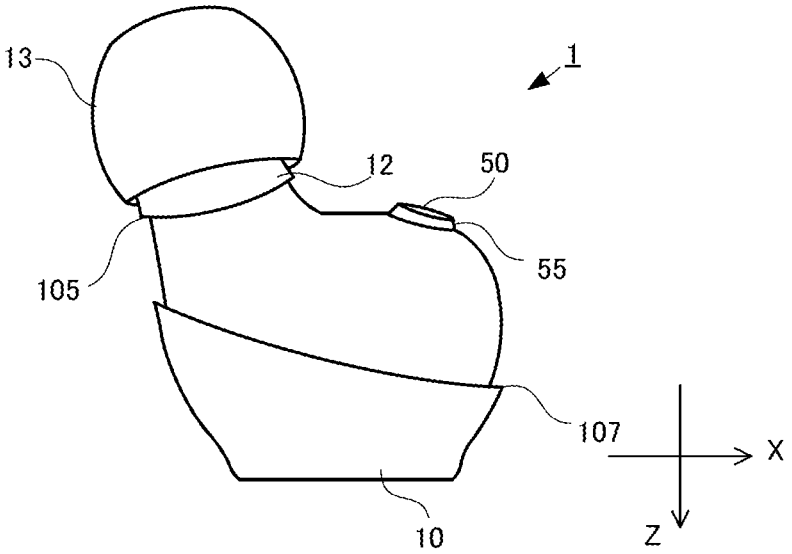
FIG. 6B is a bottom view of the earphone 1 from which the cover 11 is detached.
Figure 7A:
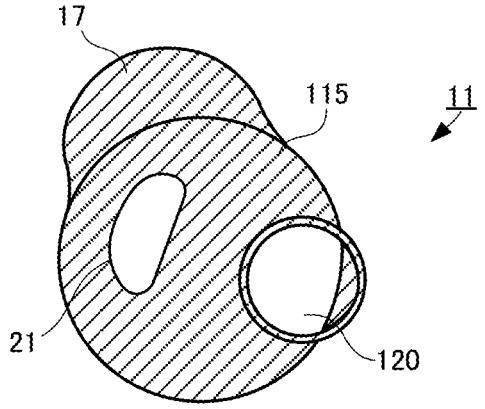
FIG. 7A is a rear view of the cover 11 detached from a driver body 10.
Figure 7B:
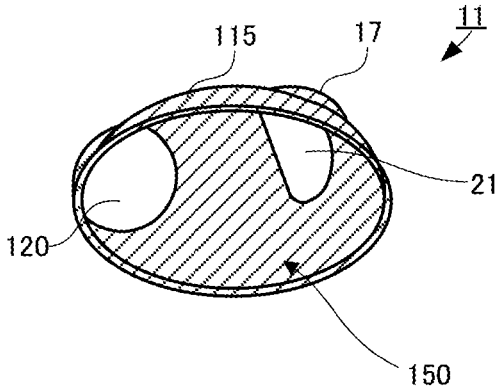
FIG. 7B is a front perspective view of the cover 11 detached from the driver body 10.

The cover 11 covers the rear side of the driver body 10. The cover 11 is configured to be attachable to and detachable from the driver body 10. FIG. 5A is a right side view of the earphone 1 from which the cover 11 is detached. FIG. 5B is a left side view of the earphone 1 from which the cover 11 is detached. FIG. 6A is a top view of the earphone 1 from which the cover 11 is detached. FIG. 6B is a bottom view of the earphone 1 from which the cover 11 is detached. FIG. 7A is a rear view of the cover 11 detached from the driver body 10. FIG. 7B is a front perspective view of the cover 11 detached from the driver body 10.

The cover 11 includes a cover body 115 including a first opening 120, a second opening 150, a third opening 21, a fourth opening 210, and a projection 17. The first opening 120 is provided on the rear side, and is a circular opening into which the insertion portion 12 is inserted. The second opening 150 is provided on the opposite side (the front side) of the first opening 120, and is the largest circular opening. The third opening 21 is provided on the rear side, and is an opening to cause the charging terminal 50 to be exposed. The fourth opening 210 is provided in the driver body 10, and is an opening having the same circular shape as a vent hole 71 for a port. The vent hole 71 is provided to improve the performance of the driver and increase bass reproducibility.

The driver body 10 has a level difference 105 corresponding to a thickness of the cover body 115 at a position corresponding to the first opening 120. The driver body 10 also has a level difference 107 corresponding to a thickness of the cover body 115 at a position corresponding to the second opening 150. The driver body 10 also has a level difference 55 corresponding to a thickness of the cover body 115 at a position corresponding to the third opening 21. A user, when attaching or detaching the cover 11, can decide a position of the cover 11 on the basis of the level differences. The height of the level differences is the same as the thickness of the cover body 115. Accordingly, when the cover body 115 is attached, the surface of the cover body 115 and the surface of the driver body 10 configure substantially the same curved surface. However, the height of the level difference does not need to be the same as the thickness of cover body 115.

A user puts the cover body 115 over the driver body 10 by inserting the insertion portion 12 from the second opening 150 to the first opening 120. The perimeter of the second opening 150 is smaller than the perimeter of the center (the maximum perimeter) of the driver body 10. The cover body 115 is made of a material with high flexibility. Therefore, the user, when putting the cover body 115 over the driver body 10, extends the second opening 150. The end on the side of the second opening 150 of the cover body 115 is located closer to the front side than to the center of the driver body 10. When the user matches the second opening 150 with the level difference 105, the cover body 115 covers the rear side, the center, and a portion of the front side of the driver body 10. Accordingly, the cover body 115 does not come off when the earphone 1 is used.

The projection 17 is provided on the right side and the top side of the rear side of the cover body. The projection 17 has a semicircular shape when viewed from the rear side or the front side. As shown in FIG. 1, the projection 17 comes into contact with a concha E of the user. In particular, the projection 17 is inserted into a recess above the concha E and comes into contact with the concha E. The bottom side of the driver body 10 comes into contact with the inside I of an antitragus. In other words, the cover body 115 comes into contact with the concha (the inside I of the antitragus) at a portion different from a portion in which the projection 17 comes into contact with the concha.

As a result, the earphone 1 is fixed to the ear of the user by the insertion portion 12 to be inserted into the ear canal, the projection 17 to come into contact with the concha E, and the driver body 10 to come into contact with the inside I of the antitragus. The earphone 1 according to the present embodiment of the present disclosure is able to achieve very high adhesion, particularly since the tip of the projection 17 is inserted into the recess above the concha E and comes into contact with the concha E.

The projection according to the present embodiment of the present disclosure has a height and a position that are specified so as to come into contact with the concha. The shapes of the concha vary depending on the size of the ear of a user. A user with a large ear has a deep recess above the concha. In addition, the recess above the concha of the user with a large ear is farther than an ear canal.

The driver body 10 is configured such that a plurality of types of covers of which the heights and positions of the projection are different are attachable to and detachable from the driver body 10. Specifically, the driver body 10 is configured such that any of a plurality of types of cover bodies 115 is attachable and detachable, each of the cover bodies 115 including the projection 17 of which a height projecting from the cover body 115 is increased as a distance from the first opening 120 (the insertion portion 12 to be inserted to an ear canal) is increased.

Figure 8A:
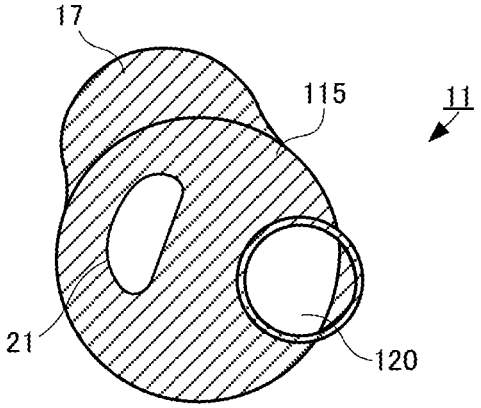
FIG. 8A is a rear view of the cover 11 detached from the driver body 10.
Figure 8B:
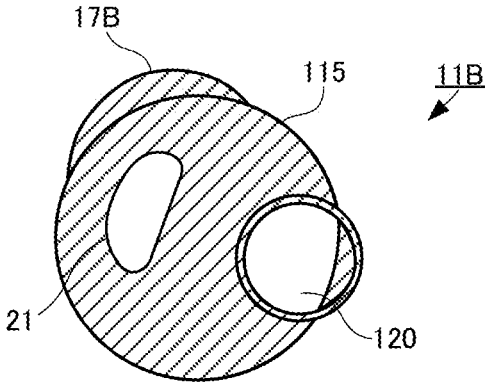
FIG. 8B is a rear view of a cover 11B of which a projection is relatively low.
Figure 9A:
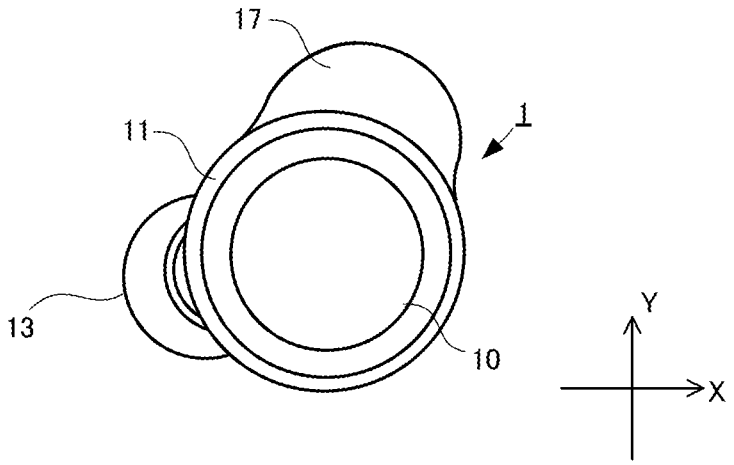
FIG. 9A is a front view of the earphone 1 to which the cover 11 is attached.
Figure 9B:
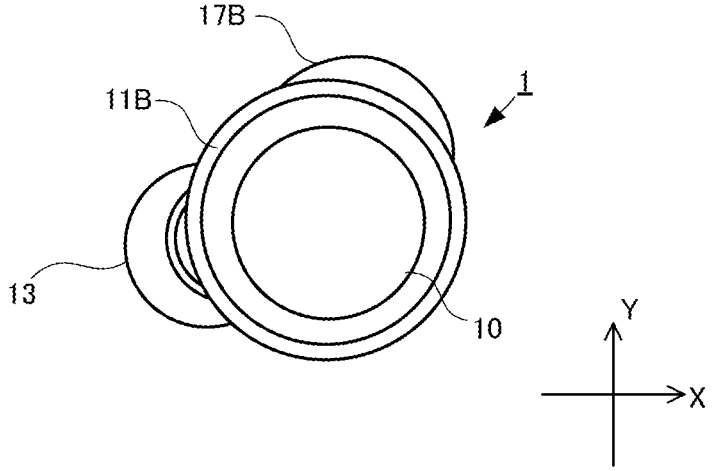
FIG. 9B is a front view of the earphone 1 to which the cover 11B is attached.
Figure 10A:
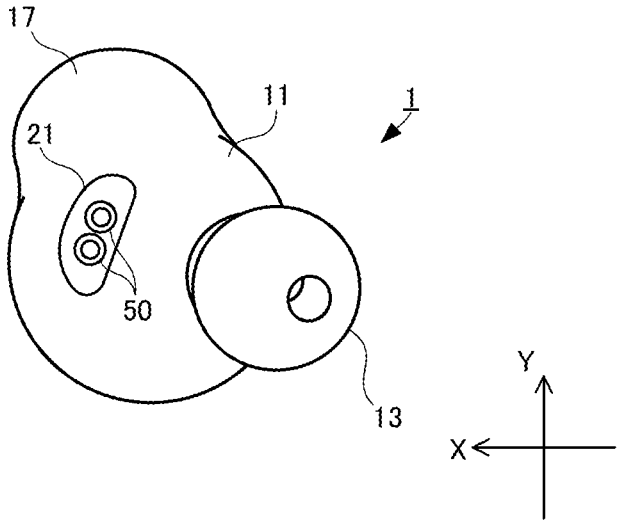
FIG. 10A is a rear view of the earphone 1 to which the cover 11 is attached.
Figure 10B:
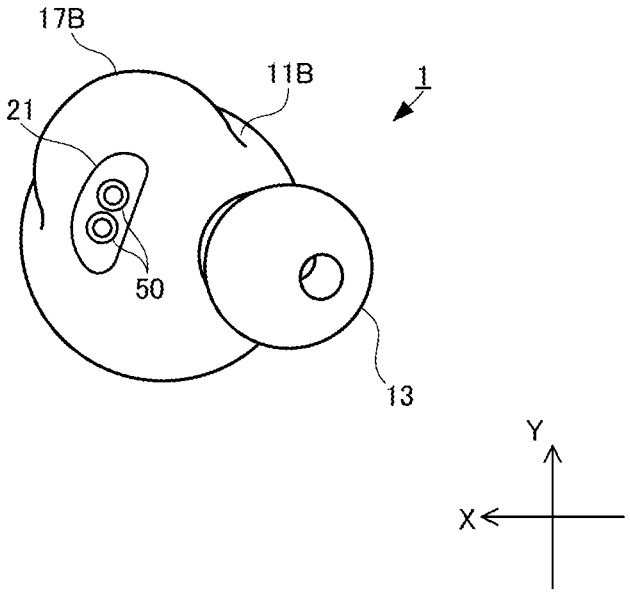
FIG. 10B is a rear view of the earphone 1 to which the cover 11B is attached.
Figure 11A:
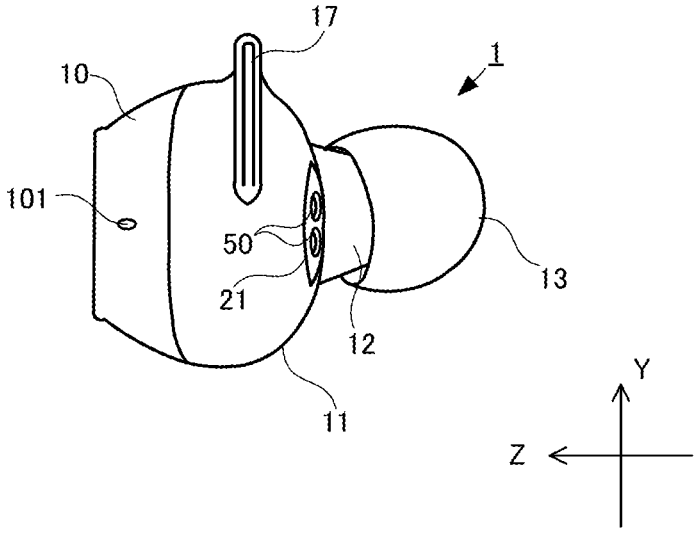
FIG. 11A is a right side view of the earphone 1 to which the cover 11 is attached.
Figure 11B:
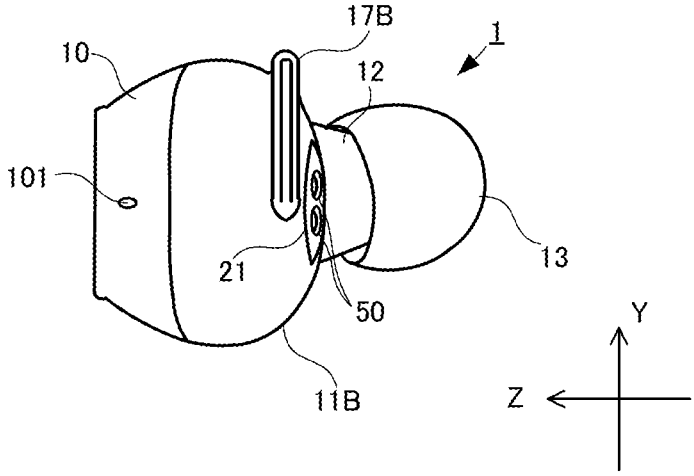
FIG. 11B is a right side view of the earphone 1 to which the cover 11B is attached.

FIG. 8A is a rear view of the cover 11 detached from the driver body 10. FIG. 8B is a rear view of a cover 11B of which a projection is relatively low. FIG. 9A is a front view of the earphone 1 to which the cover 11 is attached. FIG. 9B is a front view of the earphone 1 to which the cover 11B is attached. FIG. 10A is a rear view of the earphone 1 to which the cover 11 is attached. FIG. 10B is a rear view of the earphone 1 to which the cover 11B is attached. FIG. 11A is a right side view of the earphone 1 to which the cover 11 is attached. FIG. 11B is a right side view of the earphone 1 to which the cover 11B is attached.

The cover 11B has the same configuration as the cover 11, except for including the projection 17B. The height projecting from the cover body 115 of the projection 17B is lower than the projection 17 of the cover 11. The projection 17B is located closer to the right side than the projection 17 of the cover 11 in the right side view of FIG. 11A and FIG. 11B, and is disposed at a position closer to the first opening 120 (the insertion portion 12) than the projection 17 of the cover 11. In other words, the height of the projection projecting from the cover body 115 is increased as a distance from the opening into which the insertion portion 12 is inserted, to the projection, is increased.

Figure 12A:
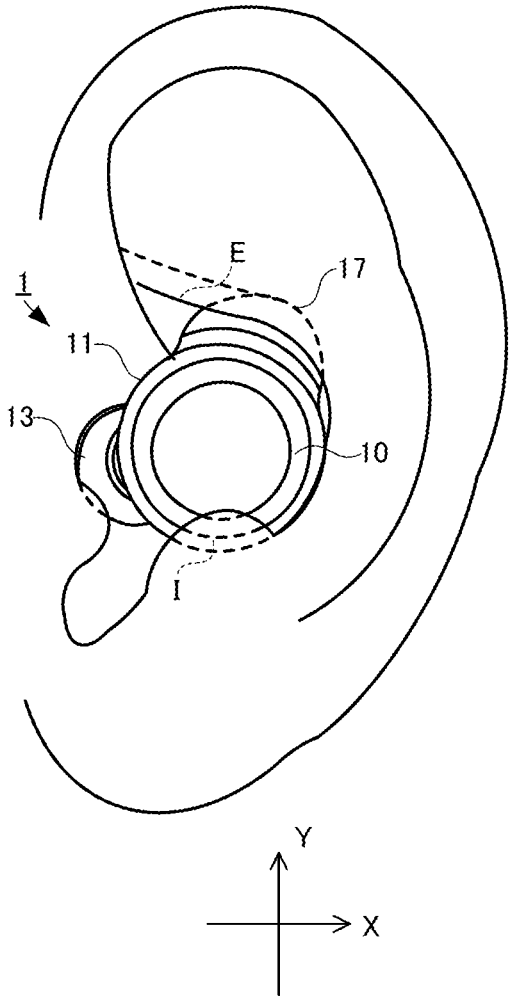
FIG. 12A is a diagram showing a state in which the earphone 1 to which the cover 11 is attached is worn in an ear.
Figure 12B:
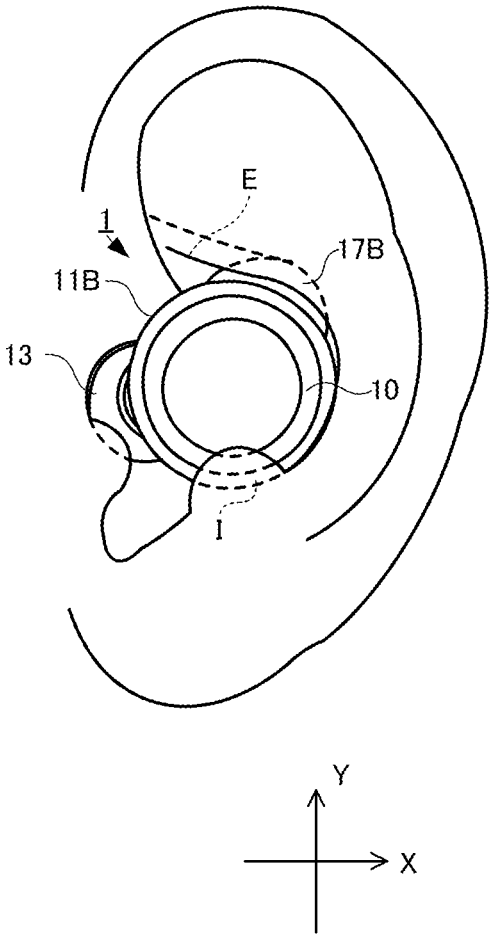
FIG. 12B is a diagram showing a state in which the earphone 1 to which the cover 11B is attached is worn in an ear.
Figure 13A:
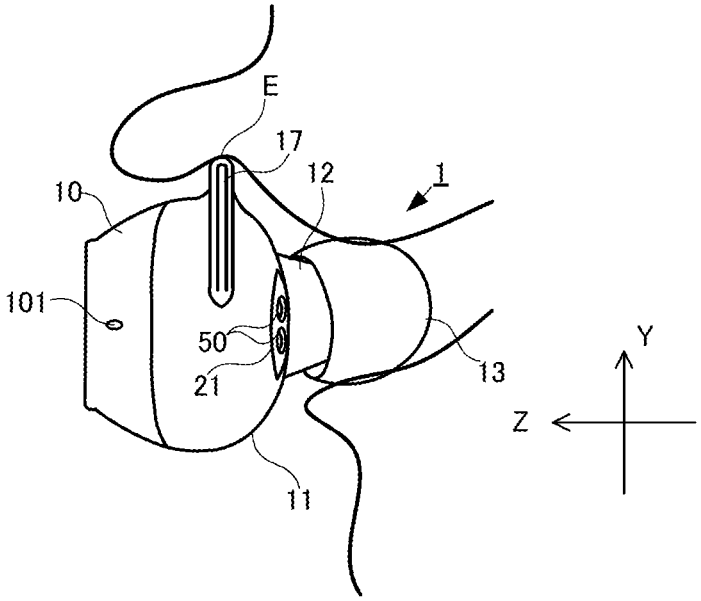
FIG. 13A is a cross-sectional view showing a state in which the earphone 1 to which the cover 11 is attached is worn in an ear.
Figure 13B:
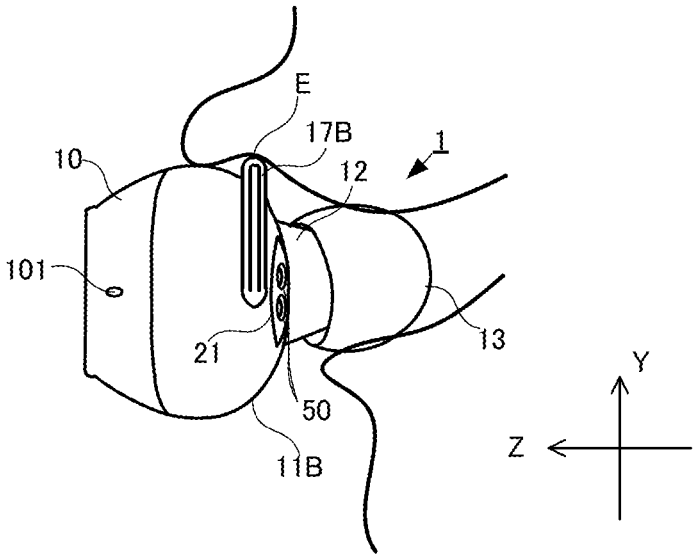
FIG. 13B is a cross-sectional view showing a state in which the earphone 1 to which the cover 11B is attached is worn in an ear.

FIG. 12A is a diagram showing a state in which the earphone 1 to which the cover 11 is attached is worn in an ear. FIG. 12B is a diagram showing a state in which the earphone 1 to which the cover 11B is attached is worn in an ear. FIG. 13A is a cross-sectional view showing a state in which the earphone 1 to which the cover 11 is attached is worn in an ear. FIG. 13B is a cross-sectional view showing a state in which the earphone 1 to which the cover 11B is attached is worn in an ear.

The cover 11 is used for a user with a relatively large ear. The cover 11B is used for a user with a relatively small ear. As shown in FIG. 12A and FIG. 12B, the user with a large ear has a deep recess above the concha E. The user with a small ear has a shallow recess above the concha E. Therefore, the user with a relatively large ear attaches the cover 11 including a high projection 17 to the earphone 1. As a result, the projection 17 properly comes into contact with the concha. Therefore, the user can achieve very high adhesion.

The user with a relatively small ear attaches the cover 11B including a low projection 17B to the earphone 1. As a result, the user with a small ear is not prevented from fitting the earphone 1 by the projection 17B, and is able to properly bring the projection 17B into contact with the concha. Therefore, the user with a small ear can also achieve very high adhesion.

As shown in FIG. 13A and FIG. 13B, the recess above the concha E of the user with a large ear is farther than an ear canal. In addition, the recess above the concha E of the user with a small ear is close to an ear canal.

Therefore, the user with a relatively large ear attaches the cover 11 including a projection 17 disposed at a position farther than the first opening 120 (the insertion portion 12), to the earphone 1. As a result, the projection 17 properly comes into contact with the concha. Therefore, the user can achieve very high adhesion.

The user with a relatively small ear attaches the cover 11B including a projection 17B disposed at a position closer to the first opening 120 (the insertion portion 12), to the earphone 1. As a result, the user with a small ear is not prevented from fitting the earphone 1 by the projection 17B, and is able to properly bring the projection 17B into contact with the concha. Therefore, the user with a small ear can also achieve very high adhesion.

As described above, the earphone 1 according to the present embodiment of the present disclosure, by being configured such that a plurality of covers having different projection heights and different distances from an ear canal are attachable to and detachable from the earphone 1, is able to achieve proper adhesion according to the size of an ear.

The description of the foregoing embodiments is illustrative in all points and should not be construed to limit the present disclosure. The scope of the present disclosure is defined not by the foregoing embodiments but by the following claims. Further, the scope of the present disclosure is intended to include all modifications within the scopes of the claims and within the meanings and scopes of equivalents.

For example, the present embodiment of the present disclosure has described that the cover 11 (the first cover) including the projection 17 disposed at a position far from the first opening 120 and having a high height projecting from the cover body 115, and the cover 11B (the second cover) including the projection 17B disposed at a position close to the first opening 120 and having a low height projecting from the cover body 115. However, a third cover including a projection disposed at a position close to the first opening 120 and having a low height projecting from the cover body 115 may be further prepared and may be attached to the earphone 1. In addition, a fourth cover including a projection disposed at a position far from the first opening 120 and having a high height projecting from the cover body 115 may be further prepared and may be attached to the earphone 1.

The present disclosure may configure a cover set including the first cover and the second cover (or further, the third cover of the like). In addition, the present disclosure may configure an earphone set including the earphone 1 and the cover set. Further, the earphone set may include the earphone 1 and a case that stores the earphone 1. In such a configuration, the case may double as a charger that comes into contact with the charging terminal 50 of the earphone 1.

In the above-described embodiment, the thickness of the cover body 115 in the cover 11 is the same as the thickness of the cover body 115 in the cover 11B. However, the thickness of the cover body 115 may be large in the cover 11 for a user with a large ear and may be small in the cover 11B for a user with a small ear. As described above, the bottom side of the driver body 10 comes into contact with the inside I of an antitragus. In a case of the user with a large ear, the distance from the inside I of the antitragus and the ear canal is increased. Therefore, the thickness of the cover body 115 is increased in the cover 11 for a user with a large ear. In other words, the cover body 115 preferably has a thickness specified so as to come into contact with the concha at a portion different from a portion in which the projection 17 comes into contact with the concha.

What is claimed is:

1. An earphone comprising:

a driver body;

an insertion portion extending from the driver body and configured to be inserted in an ear canal;

a cover body covering the driver body and including:

a first opening at a position corresponding to the insertion portion; and a projection configured to come into contact with a concha, wherein the driver body is configured to attach and detach any of a plurality of types of cover bodies each including the projection with a height thereof projecting from the cover body, the heights of the projections of the plurality of types of cover bodies being different and increasing as a distance from the opening to the respective projection is increased.

2. The earphone according to claim 1, wherein:

the cover body further includes a second opening on an opposite side of the insertion portion, and the driver body is configured to provide a level difference corresponding to a thickness of the cover body at a position corresponding to the second opening.

3. The earphone according to claim 2, wherein a perimeter of the second opening is smaller than a maximum perimeter of the driver body.

4. The earphone according to claim 1, wherein:

the cover body further includes a third opening exposing a charging terminal of the driver body, and the driver body is configured to provide a level difference corresponding to a thickness of the cover body at a position corresponding to the third opening.

5. The earphone according to claim 1, wherein the cover body further includes a fourth opening exposing a port of the driver body.

6. The earphone according to claim 1, wherein the cover body is configured to come into contact with the concha at a portion different from a portion where the projection comes into contact with the concha.

7. The earphone according to claim 1, wherein the driver body is configured to be attachable to and detachable from any of the plurality of types of cover bodies with different thicknesses.

8. A cover for a driver body of an earphone, the cover comprising:

a cover body configured to cover the driver body and including:

a first opening through which an insertion portion of the driver body to be inserted in an ear canal passes; and a projection provided with a height projecting from the cover body and positioned to come into contact with a concha, wherein the height of the projection is configured to increase as a distance from the opening to the projection is increased.

9. The cover according to claim 8, wherein the cover body further includes a second opening at a position corresponding to a charging terminal of the driver body.

10. The cover according to claim 9, wherein a perimeter of the second opening is configured to be smaller than a maximum perimeter of the driver body.

11. The cover according to claim 8, wherein the cover body further includes a third opening for exposing a charging terminal of the driver body.

12. The cover for a driver of an earphone according to claim 8, wherein the cover body further includes a fourth opening for exposing a port of the driver body.

13. The cover according to claim 8, wherein the cover body is configured to come into contact with the concha at a portion different from a portion where the projection comes into contact with the concha.

14. The cover according to claim 8, wherein the cover body is provided with a thickness configured to come into contact with the concha at a portion different from a portion where the projection comes into contact with the concha.

15. A cover set for a driver body of an earphone, the cover set comprising:

a first cover; and a second cover, wherein each of the first and second covers comprises a cover body configured to cover the driver body and including:

an opening through which an insertion portion of the driver body to be inserted in an ear canal passes; and a projection provided with a height projecting from the cover body and positioned to come into contact with a concha, wherein the projection of the first cover is at a first height and is located at a first distance from the opening thereof, wherein the projection of the second cover is at a second height and is located at a second distance from the opening thereof, wherein the first distance is farther than the second distance, and wherein the first height is greater than the second height.

* * * * *